US005199937A

United States Patent [19]

Wada et al.

[11] Patent Number: 5,199,937

[45] Date of Patent: Apr. 6, 1993

[54] CENTRIFUGAL SEPARATOR

[75] Inventors: Atsuki Wada, Uji; Akira Kasuya, Kyoto, both of Japan

[73] Assignee: Kurashiki Boseki Kabushiki Kaisha, Kurashiki, Japan

[21] Appl. No.: 892,475

[22] Filed: Jun. 2, 1992

Related U.S. Application Data

[63] Continuation of Ser. No. 573,059, Aug. 24, 1990, abandoned.

[30] Foreign Application Priority Data

Aug. 24, 1989 [JP] Japan ..... 1-219168

[51] Int. Cl.[5] ..... B04B 9/10

[52] U.S. Cl. ..... 494/7; 494/11; 494/20; 494/84

[58] Field of Search ..... 494/1, 7-9, 494/11, 16, 20, 84

[56] References Cited

U.S. PATENT DOCUMENTS

| | | | |
|---|---|---|---|
| 3,402,883 | 9/1968 | Römer | 494/11 |
| 3,674,198 | 7/1970 | Eberle | 494/7 |
| 3,877,634 | 4/1975 | Rohde et al. | 494/20 |
| 3,951,334 | 4/1976 | Fleming et al. | 494/20 |
| 4,193,536 | 3/1980 | Kubota | 494/16 |
| 4,531,652 | 7/1985 | Hara | 494/20 |

FOREIGN PATENT DOCUMENTS

| | | | |
|---|---|---|---|
| 3406208 | 8/1985 | Fed. Rep. of Germany | 494/16 |
| 68573 | 6/1979 | Japan | 494/20 |
| 777148 | 6/1957 | United Kingdom | 494/20 |

*Primary Examiner*—Philip R. Coe
*Assistant Examiner*—Mark Spisich
*Attorney, Agent, or Firm*—Wenderoth, Lind & Ponack

[57] ABSTRACT

A centrifugal separator able to function as an agitator. A motor controlled by a control box drives a disk-like rotor. For agitation, the motor makes the rotor intermittently rotate, and for centrifuging, the motor makes the rotor constantly rotate. The rotor has a pair of pins which are extended in a tangential direction to the rotation of the rotor. A bucket for accommodating a sample container is freely swingably supported by a pair of pins. During the alternate repeat of the rotation and stopping of the rotor, the bucket with the sample container performs regular swing like a pendulum in the radial direction of the rotor. The rotation of the rotor and the swing of the sample container generate a smooth circular flow of the liquid content in the sample container.

4 Claims, 3 Drawing Sheets

CENTRIFUGAL SEPARATOR

This application is a continuing application of now abandoned application, Ser. No. 573,059, filed Aug. 24, 1990. now abandoned.

BACKGROUND OF THE INVENTION

1. Field of the Invention

The present invention generally relates to a centrifugal separator, and more particularly to a centrifugal separator able to function as an agitator.

2. Description of the Related Art

In a process, for use in a clinical inspection, for analyzing substances and a process for isolating DNA (Deoxyribonucleic Acid) by using the gene manipulation technique, mixing of the samples and reagents and centrifuging of the reaction products are alternately repeated many times. In the usual operations, a sample container such as a test tube is manually or semi-automatically transferred between the agitator and the centrifugal separator. On the contrary, in gene manipulation techniques, it is desired that the sequence of operations be fully automatically carried out under a condition of biological containment in order to prevent biohazards from spreading. Accordingly, if the centrifugal separator has the function of the agitator, it is possible to simplify the automatic transfer mechanism in the fully automatically analyzing or isolating apparatus, since there is no need for transfer of the sample container between the centrifugal separator and the agitator.

In Japanese Laid-Open Utility Model Publication 59-193527, there is shown a centrifugal separator having a function of an agitator. The centrifugal separator has a rotor on which container holders for a plurality of sample containers are hung swingably in a radial direction of the rotor. The rotor is operated to rotate intermittently. During the rotation of the rotor, the sample container held by the holder swings and its lower end is lifted by generated centrifugal force. When the rotation of the rotor stops, the swung up lower end of the container is returned to the initial position and then it is caused to collide against a stopper which is arranged around the main body of the rotor and also radially inside the container holders so that the content of the container is agitated by the shock resulting from the collision. Of course the centrifuging is performed by the continuous rotation of the rotor.

However, such shock resulting from the collision is too strong for the agitating desired in the isolation of DNA. Therefore the centrifugal separator disclosed in the above Publication is not applicable to the isolation of DNA. The agitation should be smoothly performed for the isolation of DNA to avoid the breakdown of the DNA which is very weak in its resistance to mechanical force.

SUMMARY OF THE INVENTION

Accordingly, the present invention has been developed to substantially eliminate the above-described disadvantage inherent in the prior art and has as its essential object to provide an improved centrifugal separator having the function of an agitator which generates an appropriate agitating force smoothly acting on the content in the sample container so as not to break down the weak substances such as DNA included in the sample.

In accomplishing these and other objects, according to one preferred embodiment of the present invention, there is provided a centrifugal separator comprising:

a rotor rotatable in one direction;

holder means for holding a sample container so as to be swingable in a radial direction of the rotor;

support means for supporting the holder means on the rotor, the support means having an axis of rotation about which the holder means is freely swingable like a pendulum, the axis of rotation extending in a direction substantially tangential to the rotation of the rotor;

drive means for intermittently driving the rotor;

control means for controlling driving of the drive means such that, when the holder means swingably comes to a radially inner top position on a locus thereof, the drive means starts driving the rotor, while, when the holder means swingably comes to a radially outer appropriate top position on a locus thereof, the drive means stops driving the rotor.

In the centrifugal separator according to the present invention, when the agitating operation is carried out by the centrifugal separator, the drive means is controlled by the control means so that the drive means intermittently rotates the rotor. The rotor alternately repeats its rotation and its rest at a constant interval. The intermittent rotation of the rotor brings the holder means into a continuation of a regular swing of a pendulum. The sample container continues the regular swing of a pendulum too. The rotation of the rotor and the swing of the sample container generate a smooth circular flow of the liquid content in the container. The smooth circular flow subjects the liquid content which includes some weak substances into gentle agitation without breaking down the substances. When the centrifuging operation is carried out by the centrifugal separator, the rotor is constantly rotated by the drive means. When the agitation and centrifuging are alternately repeated many times, it is not necessary to transfer the sample container between the centrifugal separator and another agitator.

BRIEF DESCRIPTION OF THE DRAWINGS

These and other objects and features of the present invention will become more apparent from the following description of the preferred embodiment thereof with reference to the accompanying drawings, throughout which like parts are designated by like reference numerals, and wherein.

DETAILED DESCRIPTION OF THE PREFERRED EMBODIMENTS

Figure 1:
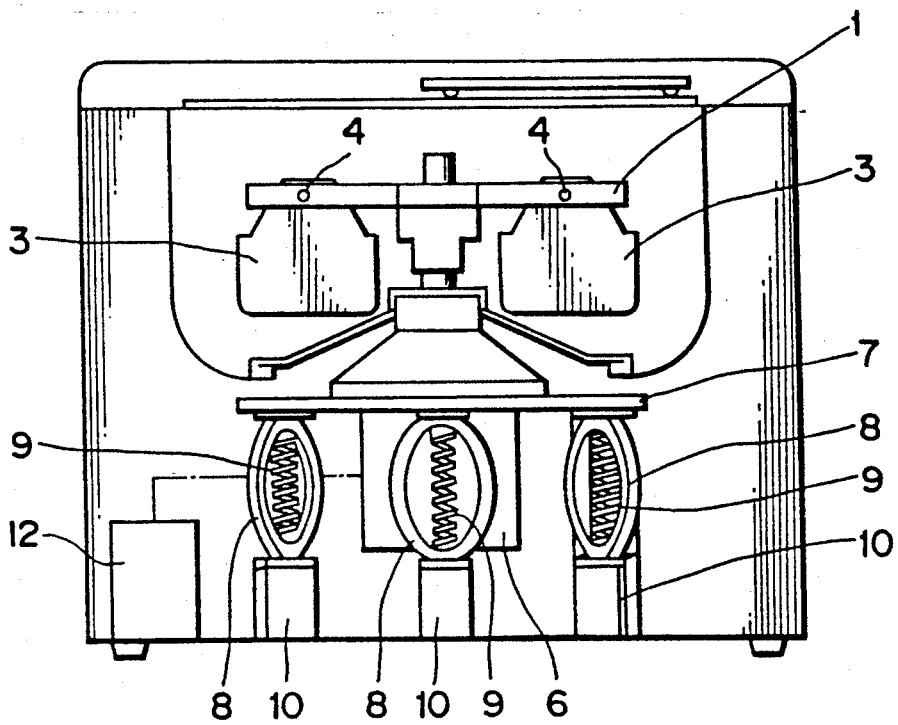
FIG. 1 is a elevational view showing the schematic construction of a centrifugal separator according to an embodiment of the present invention.
Figure 2:
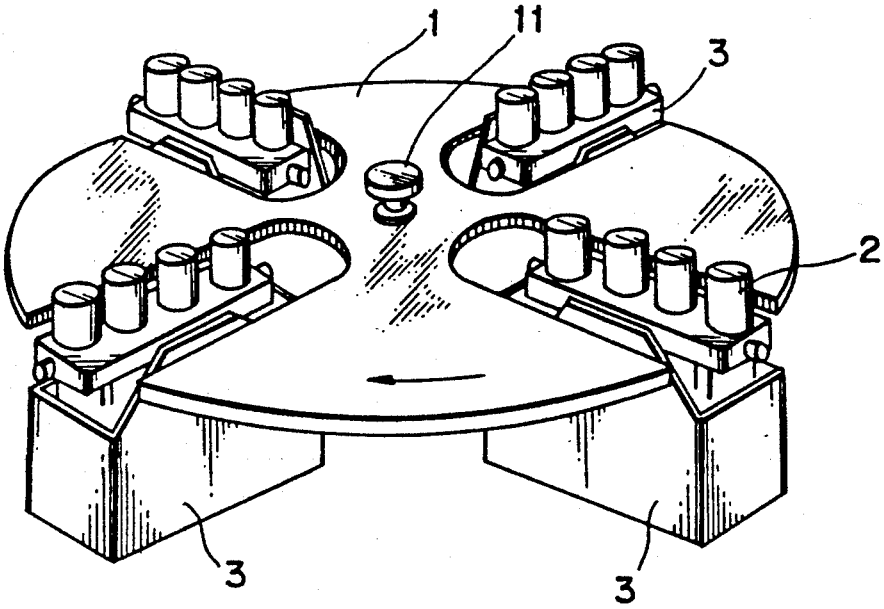
FIG. 2 is a perspective view showing a rotor and buckets with sample containers included in the centrifugal separator shown in FIG. 1.
Figure 3:
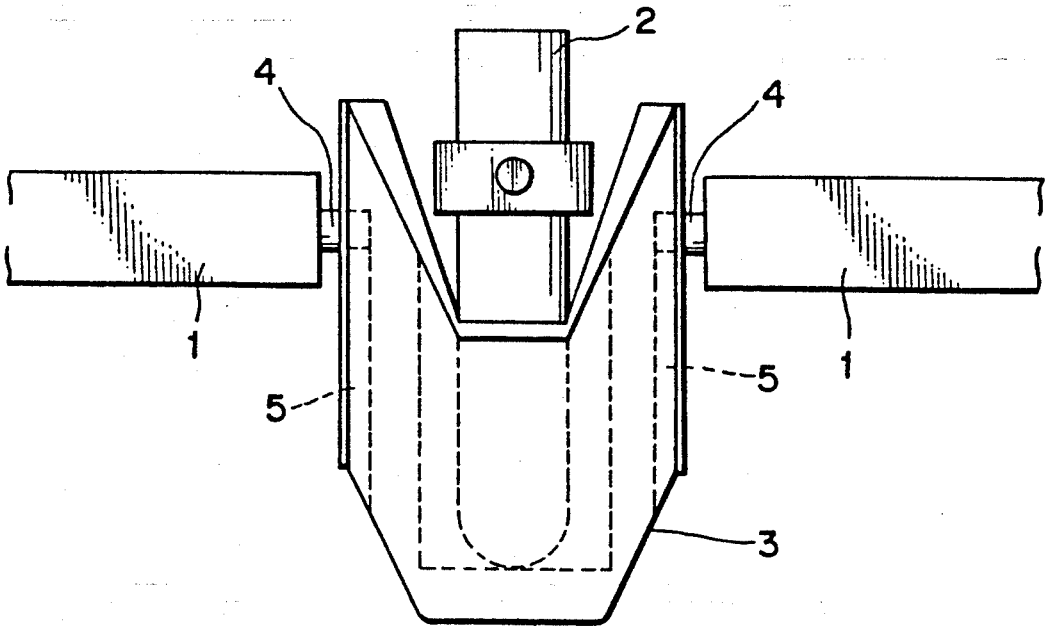
FIG. 3 is an elevational view showing the bucket of FIG. 2 by the rotor.
Figure 4:
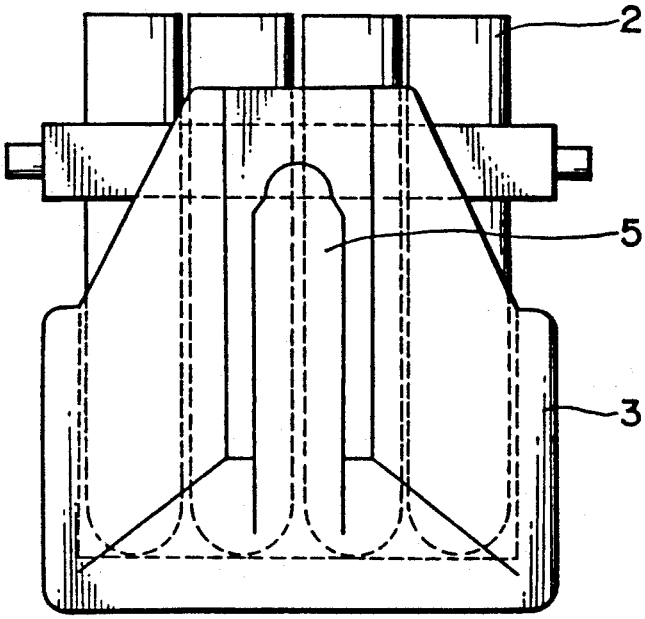
FIG. 4 is a side view showing the bucket of the FIG. 3 with the containers.

A centrifugal separator according to an embodiment of the present is shown in FIGS. 1–4. The centrifugal separator a disk-like rotor which has four recesses extending radially at a 90° central angle relative to each other. In each recess, a bucket 3 for accommodating a set of four integrally mounted tubes 2 serving as sample containers is rotatably supported by a pair of pins projecting into the recess from the rotor 1. A vertical 5 is formed in the center of each side surface of the 3. The vertical groove 5 is open at the lower end the pins 4 can be inserted into the groove 5 from The pins 4 project tangentially to the direction of rotation of the rotor, to allow the bucket to swing radially.

A shaft 11 of the rotor 1 is directly connected to the output s the motor 6 located below the rotor 1. The motor 6 on the mounting base 7 supported by a vibration damping structure which is constituted by the bracket 10 with an assembly of an oval rubber ring 8 and a coil 9. In FIG. 1, a control box for controlling the of the motor 6 is designated by the reference numeral 12.

The agitation of the samples containing DNA and reagent in the four tubes 2 will be described herebelow by making reference to FIGS. 5A-5F.

Figure 5A:
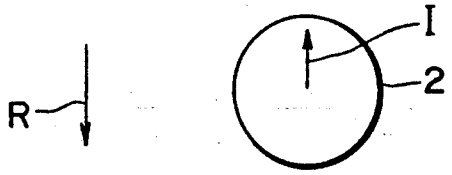
FIG. 5A–5F are explanatory views showing the process of causing the circular flow of the content in the sample container.
Figure 5B:
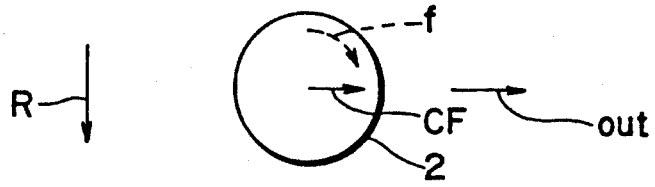
Figure 5C:
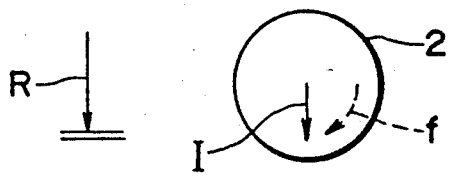
Figure 5D:
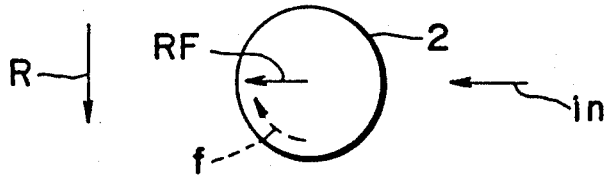
Figure 5E:
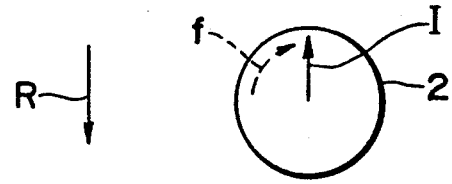
Figure 5F:
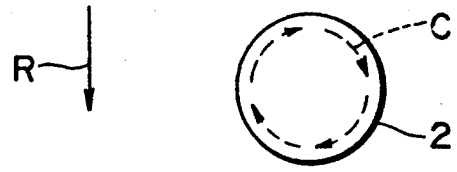

The four tubes 2 containing the sample and reagent are set in the bucket 3, and the motor 6 is intermittently driven. The rotor 1 with the bucket 3 alternately repeats its rotation and its rest condition at a constant interval e.g. at every rotation through an angle of about 30°-50°. The rotational direction is designated by an arrow R in FIGS. 5A-5B. When the rotor 1 starts rotating, the inertial force I shown in FIG. 5A acts on the liquid content in the tube 2, to move the liquid content backward in the tube 2. During the rotation of the rotor 1, centrifugal force CF shown in FIG. 5B acts on tube 2 in the bucket 3 and the content therein. The tube 2 and the bucket 3 are swung up radially and outwardly by the centrifugal force, to an outer top position resulting in the liquid content flowing outward along the inner peripheral surface of the tube 2. When the rotation of the rotor 1 is stopped, the inertial force I shown in FIG. 5C acts on the liquid content in a forward direction, resulting in flow of liquid forward along the inner peripheral surface of the tube 2. The tube 2 and the bucket 3 are consequently swung down and return inwardly by the return force RF caused by gravity, and the liquid content flows inward. Next, at the moment when the bucket 3 with the tube 2 comes to the inner top position of their swinging locus and subsequently begins swinging down outwardly, the rotor 1 caused to begin its rotation again, then the inertial force and the centrifugal force act on the bucket 3 with tube 2 and its content as shown in FIG. 5E. Thus, the liquid content in the tube 2 eventually flows circularly as shown in FIG. 5F. Thus, the agitating operation under the appropriate cycle and acceleration of the intermittent rotation of the rotor 1 produces the smooth circular flow of the liquid content in the tube 2 without mechanical shock to avoid breakdown of the above mentioned DNA. The sample and the reagent are mixed thoroughly by the above-described agitation.

The above-described interval and the intermittent rotation of the rotor 1 are chosen on the basis of the various physical factors such as the amount of the liquid content, the viscosity of the liquid content, the desirable flow rate of the substances contained in the sample and the like. The rotational speed of the rotor 1 is preferably set at about 70 r.p.m.

After the agitating operation, if the rotor 1 is rotated continuously together with the tube 2 remaining in the bucket 3, centrifugal separating is performed. Accordingly, it is not necessary to transfer the tube 2 between the centrifugal separator and another agitator.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A centrifugal separator able to function as an agitator, comprising:

a rotor rotatable in one direction;

holder means for holding a sample container;

support means supporting said holder means on said rotor, said support means having an axis of rotation about which said holder is freely radially swingable on said holder means along a path like a pendulum between an outer top position established by centrifugal force on said holder and an inner top position to which said holder swings freely through unobstructed space to the limit of free pendulum motion due to gravity, said axis of rotation extending in a direction substantially tangential to the direction of rotation of said rotor, said support means having said path free of obstructions throughout the swinging motion of said holder;

drive means driving said rotor in said direction; and control means connected to said drive means for controlling the rotation speed of said drive means for driving said rotor at a rotational speed sufficient for radially outwardly swinging said holder means holding a sample container in which a predetermined amount of a sample and reagents are contained sufficiently for causing the lower end of said holder means to be raised up by centrifugal force to said outer top position, and controlling a timing of the operation of said drive means for intermittently starting and stopping the driving of said rotor in said one direction for causing successive rocking movements of said holder between said outer top position and said inner top position to give a swirling motion to the sample in the sample container.

2. A centrifugal separator according to claim 1, wherein said holder means is restricted to a radial swinging movement.

3. A centrifugal separator according to claim 1, wherein said support means comprises a pair of pins projecting from said rotor, said holder means having a pair of vertical grooves receiving said pins respectively.

4. A centrifugal separator according to claim 1 wherein said sample container is a set of integrated four tubes.

* * * * *